US007069766B2

(12) United States Patent
Hayashi et al.

(10) Patent No.: US 7,069,766 B2
(45) Date of Patent: Jul. 4, 2006

(54) COPE HOLDER DEVICE

(75) Inventors: Shiro Hayashi, Isehara (JP); Yuki Takahashi, Isehara (JP); Toshiro Kawano, Odawara (JP)

(73) Assignee: Amada Company, Limited, Kanagawa (JP)

( * ) Notice: Subject to any disclaimer, the term of this patent is extended or adjusted under 35 U.S.C. 154(b) by 245 days.

(21) Appl. No.: 10/467,171

(22) PCT Filed: Feb. 13, 2002

(86) PCT No.: PCT/JP02/01190

§ 371 (c)(1),
(2), (4) Date: Aug. 13, 2003

(87) PCT Pub. No.: WO02/064278

PCT Pub. Date: Aug. 22, 2002

(65) Prior Publication Data

US 2004/0074278 A1 Apr. 22, 2004

(30) Foreign Application Priority Data

Feb. 14, 2001 (JP) ..... 2001-036730

(51) Int. Cl.
*B21D 37/00* (2006.01)

(52) U.S. Cl. ..... 72/481.3; 72/479; 72/481.1; 72/482.91; 72/482.94

(58) Field of Classification Search ..... 72/479–482.94
See application file for complete search history.

(56) References Cited

U.S. PATENT DOCUMENTS

| | | | | |
|---|---|---|---|---|
| 5,460,027 | A | | 10/1995 | Takahashi |
| 5,507,170 | A | | 4/1996 | Kawano |
| 5,511,407 | A | | 4/1996 | Kawano |
| 5,513,514 | A | | 5/1996 | Kawano |
| 5,619,885 | A | * | 4/1997 | Kawano et al. ..... 72/481.8 |
| 5,642,642 | A | | 7/1997 | Kawano |
| 5,685,191 | A | * | 11/1997 | Kawano et al. ..... 72/482.91 |
| 5,794,486 | A | * | 8/1998 | Sugimoto et al. ..... 72/481.3 |

FOREIGN PATENT DOCUMENTS

| | | |
|---|---|---|
| EP | 682995 | 11/1995 |
| EP | 767015 | 4/1997 |

* cited by examiner

*Primary Examiner*—Jack Keith
*Assistant Examiner*—Hung C. Le
(74) *Attorney, Agent, or Firm*—Greenblum & Bernstein, P.L.C.

(57) ABSTRACT

An upper die holder apparatus having a holder body has an upper die clamp supported to the holder body with a supporting point supporting the upper die clamp in a vicinity of a center in a vertical direction of the holder body. A clamping force applier is provided to the holder body for pressing an upper portion of the upper die clamp so that the upper die clamp clamps the upper die. A pressure receiver is provided to an upper portion of the upper die clamp. The pressure receiver, having a pressure sensing surface, is provided so that its advancing and retreating are adjusted to a pressing direction by the clamping force applier and the pressure receiver is provided so that an opening amount of the upper die clamp at the time of unclamping is freely selected between a plurality of stages.

4 Claims, 6 Drawing Sheets

COPE HOLDER DEVICE

TECHNICAL FIELD

The present invention relates to upper die holder apparatus in a press brake, and more specifically relates to the upper die holder apparatus which is capable of easily attaching/detaching an upper die to/from an upper table in the press brake so as to replace it.

BACKGROUND ART

Conventionally, press brakes are constituted so that an upper table (occasionally called as an upper apron) and a lower table (occasionally called as a lower apron) are opposed to each other in a vertical direction, and suitable one of the upper table and the lower table is driven up and down as a ram.

In the press brakes having the above constitution, in order to bend a plate shaped workpiece, a lower die (die) is attached to an upper portion of the lower table and an upper die (punch) is attached to a lower portion of the upper table.

In the above constitution, after a workpiece is located on the lower die, the upper die is engaged with the lower die so that the workpiece can be bent.

Incidentally, in press brakes, in order to replace the upper die according to a difference in bending forms or the like of workpieces, for example, many upper die holder apparatuses are attached to the lower portion of the upper table, and these upper die holder apparatuses support the upper die to the upper table so that the upper die can be detached and replaced.

With reference to FIGS. 1 and 2, a prior upper die holder apparatus 101 is provided with a holder body 105 which is attached to an upper table 103 detachably, an upper die supporting section 109 for supporting an upper die 107 is provided so as to be integral with a lower portion of the holder body 105, and an upper die clamp 111 which freely presses and fixes an upper portion of the upper die 107 to the holder supporting section 109 is supported to the holder body 105 in a rocking manner with a vicinity of an approximately center in a vertical direction being as a supporting point.

Further, a pressing member 113 for pressing the upper die 107 against the upper die supporting section 109 is provided to a lower portion of the upper die clamp 111, a wedge piece 115 (locking member) which freely locks into a drop-proof groove 107G provided to the upper die 107 is provided below the pressing member 113 so as to freely advance and retreat, and is biased to a direction of the upper die supporting section 109 by a resilient member 117. An inclined plane 115S is formed on an upper surface of a tip of the wedge piece 115 so as to be easily engaged with and detached from the drop-proof groove 107G. The wedge piece 115 is composed of a plurality of wedge piece dividing pieces.

Further, a clamping force applying means 119 for pressing the upper portion of the upper die clamp 111 so as to apply a clamping force for clamping the upper die 107 via the upper die clamp 111 is provided to the holder body 105.

The clamping force applying means 119 is included in a cylinder 121 of a front-rear direction provided to the holder body 105, and two pistons 123 are provided slidably in the cylinder 121 in the front-rear direction. Pin-shaped pusher sections 125 are projected respectively from the pistons 123 towards the outside, and the pusher sections 125 are projected outward. Tips of the pusher sections 125 can touch and separate from a pressing screw 127 as a pressure receiving section provided to the upper portion of the upper die clamp 111.

Further, a resilient member 129 such as a coil spring for always biasing the piston 123 so as to always press the piston 123 inward is wound around the pusher sections 125 of the pistons 123. Moreover, an oil passage 131 which communicatively connects to an inside of the cylinder 121 is formed on the holder body 105, and the oil passage 131 is communicatively connected with a pressure oil supply source (not shown) via a hydraulic hose 133.

In addition, an adapter plate 135 having a divergent notched portion on its lower center is mounted integrally to a front surface of the holder body 105. The adapter plate 135 touches a front lower portion of the upper table 103, and a clamp jaw 139 is clamped by a clamping bolt 137 screwed up to the upper table 103 so that the adapter plate 135 is pressed and fixed to the upper table 103. As a result, the holder body 105 is mounted to the upper table 103.

In order to adjust a vertical position (height position) of the holder body 105, a wedge member 141 lies between an upper surface of the holder body 105 and a lower surface of the upper table 103 so that its position is freely adjusted to a horizontal direction, and a fixing bolt 145 which pierces a slot 143 in the horizontal direction provided on the adapter plate 135 is screwed up into the wedge member 141.

In the prior constitution, therefore, when upper die 107 is detached from the upper table 103 so as to be replaced, the pusher sections 125 of the pistons 123 in the cylinder 121 are retreated so that the upper die clamp 111 is in an unclamped state. The wedge piece 115 (a plurality of wedge piece dividing pieces) which is biased by the resilient member 117 is hooked on the drop-proof groove 107G of the upper die 107 so that the in upper die 107 it held. When the upper die 107 is front-removed the upper die 107 is twisted so that the wedge piece 115 is retreated against the biasing force of the resilient member 117 and the upper die 107 is removed.

Further, at the time of attaching, namely, first-feeding the upper die 107, when the upper die 107 is inserted between the upper die supporting section 109 of the holder body 105 and the upper die clamp 111 from a lower side, the wedge piece 115 is retreated against the biasing force of the resilient member 117 and then is advanced again by the resilient member 117 so as to be hooked onto the drop-proof groove 107G of the upper die 107 and the upper die 107 is held.

At the time of replacing the upper die 107, however, when a stronger force than the biasing force of the resilient member 117 is applied to the upper die 107 in such a manner that the upper die 107 is slid mightily or a twisting force is suddenly applied to the die, there is a danger such that the upper die 107 drops even when it is not front-fed and front-removed.

The present invention is devised in order to solve the above problem, and an object of the invention is to provide an upper die holder apparatus which is capable of easily detaching an upper die from a press brake and replacing it, and moving the upper die to a horizontal direction without a danger such that the upper die drops particularly when the upper die is not front-fed and front-removed.

DISCLOSURE OF THE INVENTION

In order to achieve the above object, an upper die holder apparatus of the present invention based on a first aspect includes: a holder body; an upper die supporting section provided to a lower portion of the holder body, the upper die supporting section for supporting an upper die; an upper die clamp supported to the holder body in a rocking manner, the upper die clamp being supported in a rocking manner with a vicinity of a center in a vertical direction of the holder body being as a supporting point; a pressing member provided to a lower portion of the upper die clamp, the pressing member for pressing the upper die against the upper die supporting section; a locking member provided to a lower portion of the upper die clamp, the locking member being biased towards the upper die supporting section so as to freely lock into a drop-proof groove provided to the upper die; clamping force applying means provided to the holder body, the clamping force applying means pressing an upper portion of the upper die clamp so that the upper die clamp clamps the upper die; and a pressure receiving member provided to an upper portion of the upper die clamp, the pressure receiving member having a pressure sensing surface to be pressed by the clamping force applying means. In the above constitution, the pressure receiving member is provided so that its advancing and retreating are adjusted to a pressing direction by the clamping force applying means, and the pressure receiving member is provided so that an opening quantity of the upper die clamp at the time of unclamping is freely selected between a plurality of stages.

Therefore, since the a position of the pressure sensing surface of the pressure receiving member can be selected from a plurality of stages, the opening quantity of the upper die clamp at the time of unclamping can be switched between a plurality of stages by a simple operation. When the upper die is not front-fed and front-removed, for example, the opening quantity is set to be small, so that the upper die can be moved to a lateral direction without a danger such that of dropping. When the opening quantity is set to large, suitable one of both left and right sides of the upper die is inclined downward, the upper die is pushed easily against the biasing force of the locking member and simultaneously the upper die is front-fed and front-removed easily.

In an upper die holder apparatus of the present invention based on a second aspect depending from the upper die holder apparatus based on the first aspect, the opening quantity of the upper die clamp at the time of unclamping is adjustable so that a locked state between the locking member and the drop-proof groove of the upper die is freely selected from a first stage where the upper die cannot be drawn downward and a second stage where the upper die can be drawn downward.

Therefore, when the upper die is not front-fed and front-removed, therefore, the opening quantity is set to the first stage so that the upper die can be moved to a lateral direction without a danger of dropping. When the opening quantity is set to the second stage, the upper die is easily front-fed and front-removed.

In an upper die holder apparatus of the present invention based on a third aspect depending from the upper die holder apparatus based on the first or second aspect, the pressure receiving member is screwed into the upper portion of the upper die clamp, and a position lever which is rotated so as to advance and retreat the pressure receiving member gradationally is provided to the pressure receiving member.

Therefore, since a position of the pressure sensing surface of the pressure receiving member is switched gradually between the plural stages only by a simple operation for rotating the position lever, the opening quantity of the upper die clamp at the time of unclamping is easily switched between the plural stages.

THE BEST MODE FOR CARRYING OUT THE INVENTION

Modes of an upper die holder apparatus and a method of removing an upper die from the upper die holder apparatus according to the present invention are explained below with reference to the drawings.

Figure 5:
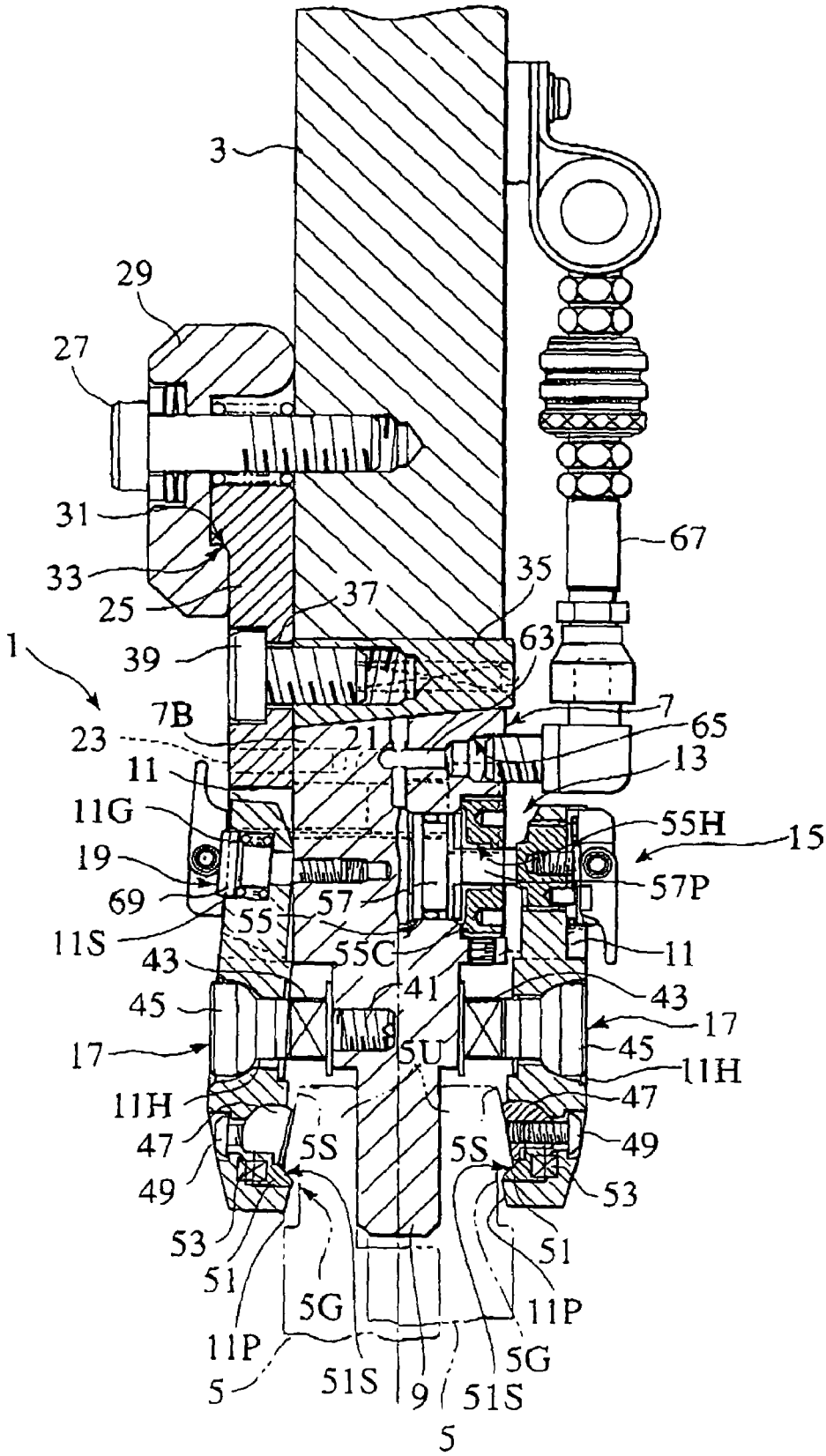
FIG. 5 shows the mode of the present invention: a right side with respect to an extended line of a center line drawn on an upper part is a sectional view taken in the direction of the arrow along the line V—V in FIG. 6 that illustrate a state that the upper die clamp clamps the upper die; and a left side with respect to the extended line of the center line is a sectional view taken in the direction of the arrow along the line V'–V in FIG. 6 that illustrates a state that the upper die clamp is opened.
Figure 6:
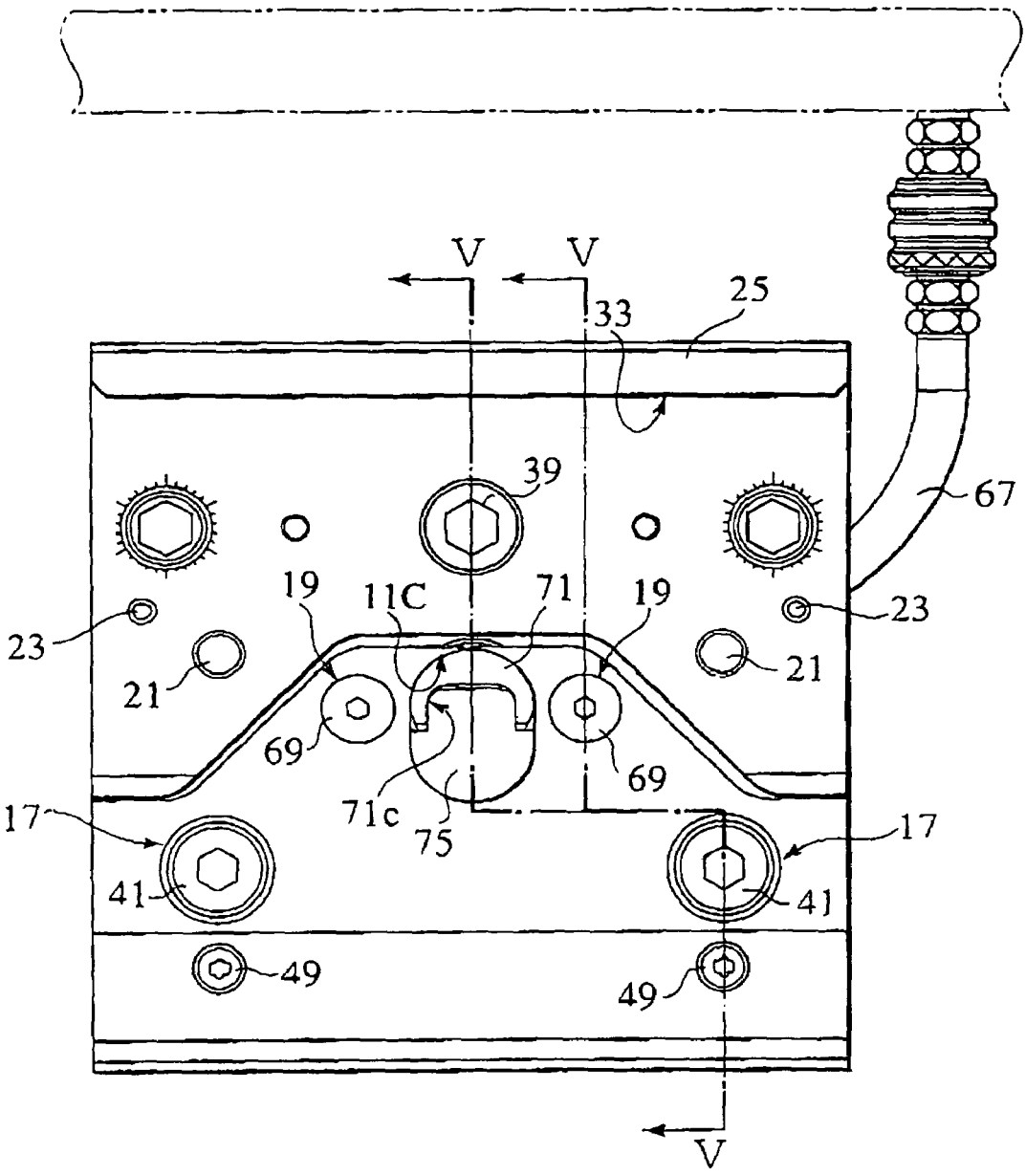
FIG. 6 is a front view of the upper die holder apparatus illustrating the mode of the present invention.

With reference to FIGS. 5 and 6, an upper die holder apparatus 1 of this mode is attached detachably to a lower portion of an upper table 3 in a press brake (an entire constitution is not shown). Many upper die holder apparatuses 1 are attached to the lower portion of the upper table 3 in a horizontal direction with suitable intervals.

That is to say, an upper die 5 in the press brake is composed of one upper die which is long in a horizontal direction (in FIG. 5, a direction vertical to a sheet surface, and in FIG. 6, the horizontal direction), or a plurality of divided type upper dies having different lengths which are suitably combined to be used. In order to cope with both the cases, the many upper die holder apparatuses 1 are attached to the upper table 3 with suitable intervals.

As is clear from FIG. 5, the upper die holder apparatus 1 is constituted so as to include a holder body 7 which is detachably attached to the upper table 3, an upper die clamp 11 which freely presses and fixes an upper portion 5U of the upper die 5 to an upper die supporting section 9 provided integrally with a lower portion of the holder body 7, clamping force applying means 13 for applying a clamping force to the upper die clamp 11, clamp switching means 15 for freely transmitting and removing the clamping force by the clamping force applying means 13 to/from the upper die clamp 11, upper die clamp holding means 17 for holding the upper die clamp 11 to a lower portion of the holder body 7 in a rocking manner, and releasing state holding means 19

(see FIG. 6) for freely holding the upper die clamp 11 in a state that the clamp of the upper die 5 is released.

More specifically, the holder body 7 has the upper die supporting section 9 with thin thickness which is integral with a lower portion of a block section 7B which is thick in a front-rear direction. An adapter plate 25 which projects upward is attached integrally to a front surface (in FIG. 5, a left surface) of the block section 7B of the holder body 7 by a plurality of bolts 21 and pins 23 (see FIG. 6).

The adapter plate 25 has, as shown in FIG. 6, a divergent notched portion on its lower center. As shown in FIG. 5, a rear surface of the upward projected portion of the adapter plate 25 touches a front lower portion of the upper table 3, a clamp jaw 29 is clamped by a clamping bolt 27 screwed up into the upper table 3, and the upward projected portion of the adapter plate 25 is pressed and fixed to the upper table 3, so that the holder body 7 can be attached to the upper table 3.

A locking section 31 projects from a rear surface of a lower portion of the clamp jaw 29, and a hooking section 33 which can be hooked on the locking section 31 projects from a front surface of the upward projected portion of the adapter plate 25. When the holder body 7 is attached, therefore, even if the clamping bolt 27 is loosened, the hooking section 33 of the adapter plate 25 is engaged with the locking section 31 of the clamp jaw 29, thereby preventing the adapter plate 25 from dropping.

In order to adjust a vertical position (height position) of the holder body 7, a wedge member 35 lies between an upper surface of the holder body 7 and a lower surface of the upper table 3 so that its position is freely adjusted to the horizontal direction in FIG. 5, and a fixing bolt 39 which pierces an insertion hole 37 provided on the adapter plate 25 is screwed into the wedge member 35.

In the above constitution, the clamp jaw 29 is maintained to be clamped loosely so that the holder body 7 does not drop, and the wedge member 35 is adjusted to the horizontal direction in FIG. 5 in a state that the fixing bolt 39 is loosened, thereby finely adjusting the holder body 7 up and down with respect to the upper table 3.

The upper die clamp 11 is composed of a plate shaped member having approximately same width as a width of the holder body 7 in the horizontal direction, and a corresponding upward projected portion is formed on a portion of the adapter plate 25 corresponding to the divergent notched portion. In order to press and fix the upper section 5U of the upper die 5 between the upper die supporting section 9 and the upper die clamp 11, the upper die 5 is supported to the holder body 7 by the upper die clamp holding means 17 in a rocking manner.

More specifically, in the upper die clamp holding means 17, a plurality of through holes 11H are provided on a vicinity of a center of the upper die clamp 11 in the vertical direction, a mounting bolt 41 pierces the through holes 11H and is screwed up and fixed to a left side of the upper die supporting section 9 horizontally in FIG. 5, and a coil spring 43, which biases the upper die clamp 11 to a direction where the upper die clamp 11 is always pressed, is set resiliently so that the upper die clamp 11 is held on a head portion of the mounting bolt 41. As a result, the upper die clamp 11 is supported in the rocking manner.

Further, a mounting nut 45 which pierces the through holes 11 on the upper die clamp 11 on a right side in FIG. 5 is screwed up and fixed to a screw portion of the mounting bolt 41 which projects horizontally to the right side of the upper die supporting section 9 in FIG. 5, and the coil spring 43, which biases the upper die clamp 11 to a direction where the upper die clamp 11 is always pressed, is set resiliently so that the upper die clamp 11 is held on the head portion of the mounting nut 45. As a result, the upper die clamp 11 is supported in the rocking manner.

Here, touching portions between the head portions of the mounting bolt 41 and the mounting nut 45 and the through holes 11H are formed into a spherical contact surface so that the upper die clamps 11 rocks smoothly.

Figure 8:
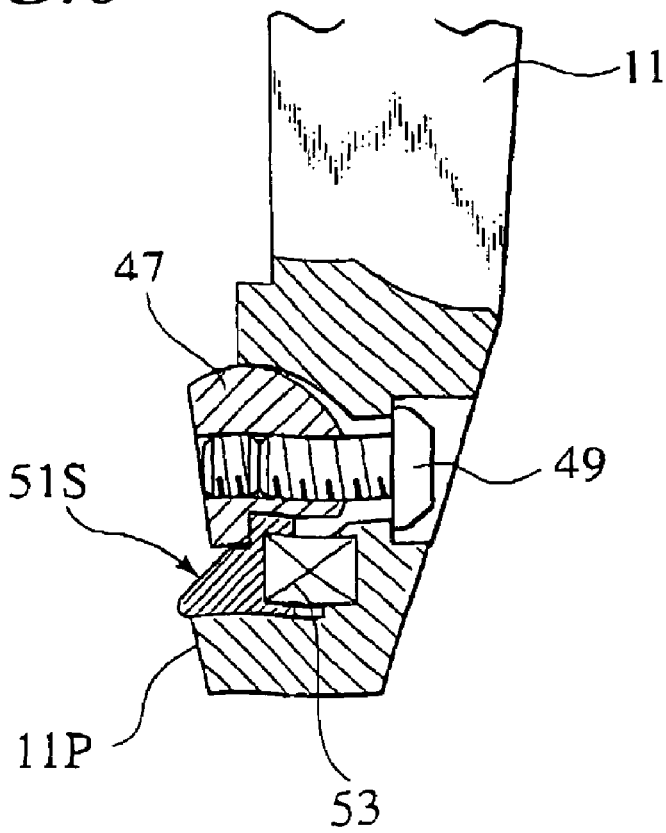
FIG. 8 is a partially sectional view of a lower portion of the upper die clamp.

With reference also to FIG. 8, a locking projection 11P, which freely locks into a drop-proof groove 5G in the horizontal direction formed on the upper portion of the upper die 5, is formed on a lower end of the upper die clamp 11 so as to project towards the upper die supporting section 9. A pressing member 47, which touches an inclined plane 5S of the upper section 5U of the upper die 5 so as to press the upper die 5 against the upper die supporting section 9, is provided to a slightly upper portion of the locking projection 11P.

The pressing member 47 has a form obtained by working a part of a peripheral surface of a circular cylinder into a plane, and the pressing member 47 is mounted to the lower portion of the upper die clamp 11 via a plurality of screws 49 in a slightly rotatable manner.

Further, a wedge piece 51 (locking member) which is freely engaged with the drop-proof groove 5G of the upper die 5 is provided on an upper portion of the locking projection 11P and between the pressing member 47 and the locking projection 11P so as to freely advance and retreat. The wedge piece 51 is always biased so as to be engaged with the drop-proof groove 5G by a function of a resilient member 53 such as a coil spring resiliently set between the wedge piece 51 and the upper die clamp 11.

Movement of the wedge piece 51 by means of the biasing force is restrained in such a manner that a part of the wedge piece 51 touches a part of the pressing member 47, and an inclined plane 51S is formed on an upper surface of an edge of the wedge piece 51 so that the wedge piece 51 is easily engaged with and disengaged from the drop-proof groove 5G.

Figure 1:
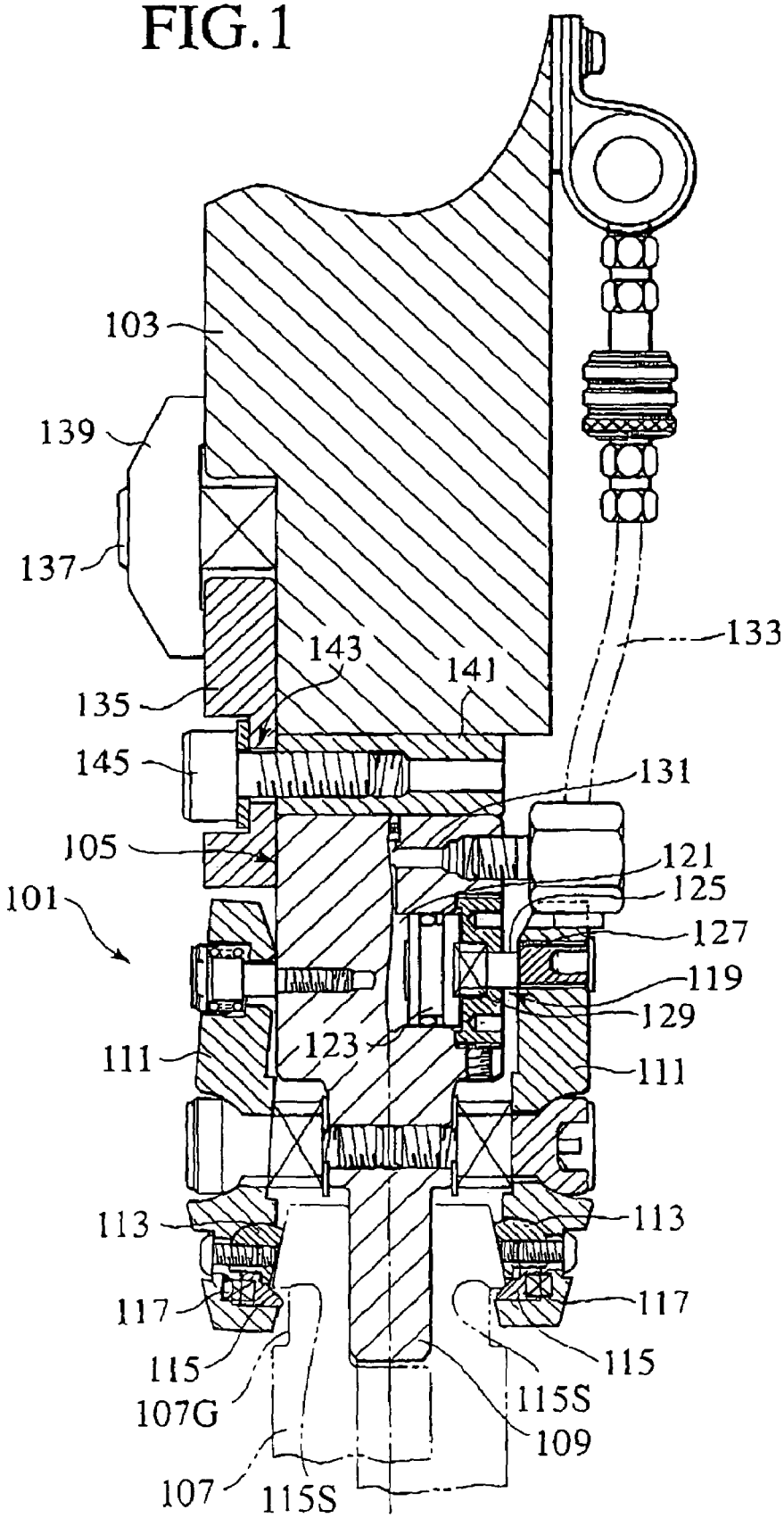
FIG. 1 is a sectional view of FIG. 2 illustrating a prior example: a left side with respect to a center line illustrates a state that an upper die clamp is opened: and a right side illustrates a state that the upper die clamp clamps an upper die.
Figure 2:
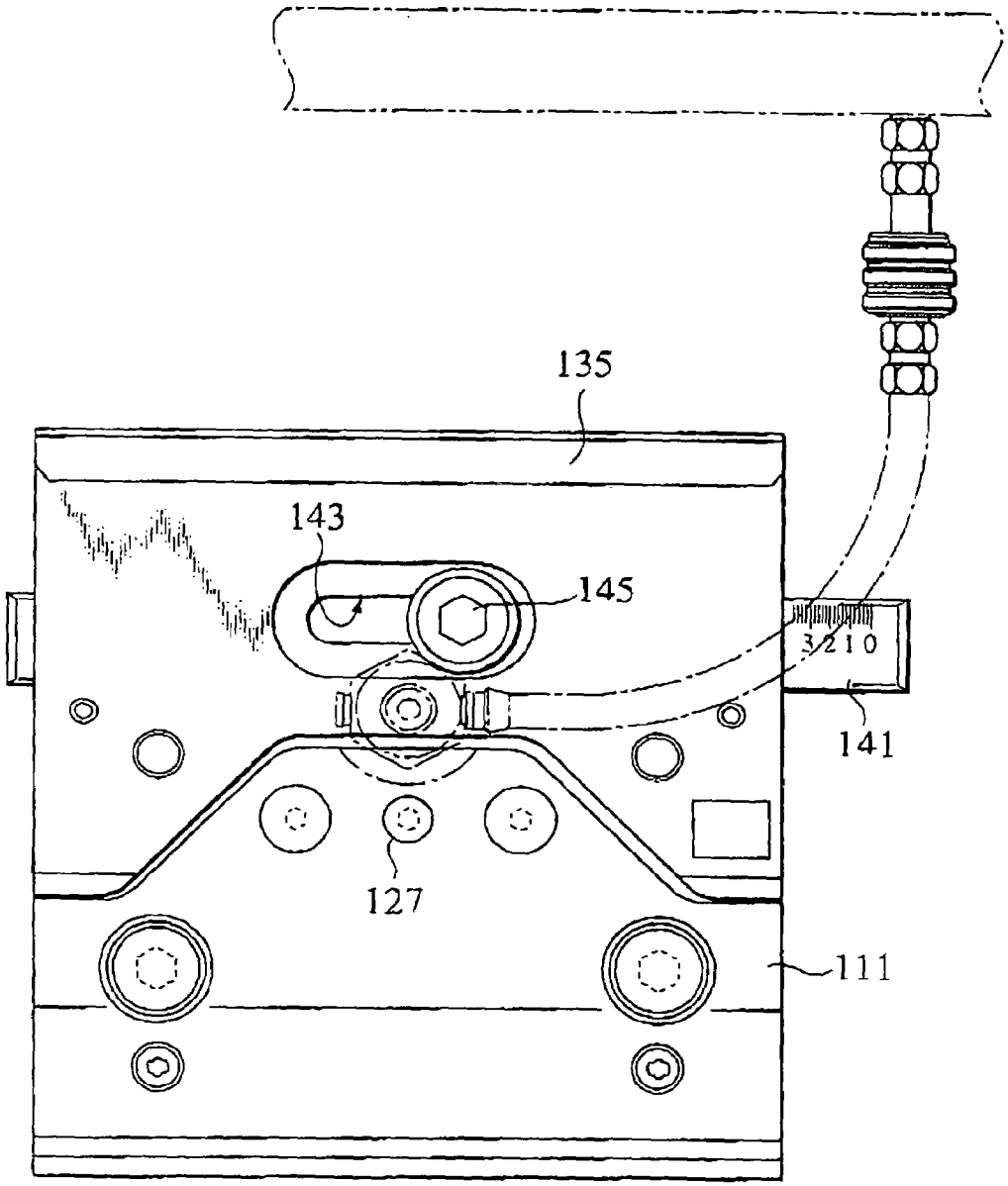
FIG. 2 is a front view of an upper die holder apparatus according to a prior example.
Figure 3:
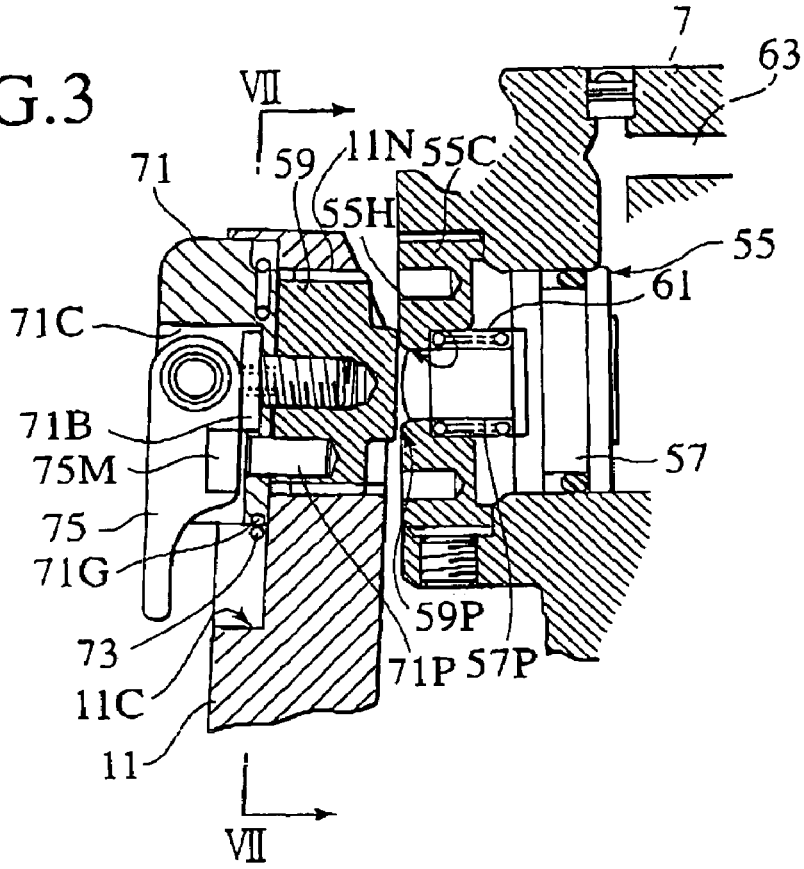
FIG. 3 is a partially sectional view of a mode of the present invention illustrating a first-stage switching state by means of a position lever when the upper die clamp is in an unclamped state.

With reference also to FIG. 3, the clamping force applying means 13, which applies the clamping force for pressing and fixing the upper die 5 to the upper die supporting section 9 using the pressing member 47 provided on the lower portion of the upper die clamp 11 to the upper die clamp 11, is included in a cylinder 55 in the front-rear direction provided on the block section 7B of the holder body 7.

More specifically, the clamping force applying means 13 is constituted so that both sides in the front-rear side of the cylinder 55 are blocked by cover sections 55C, respectively, and two pistons 57 are provided slidably to the front-rear direction in the cylinder 55. A pin-shaped pusher section 57P is projected to the outside of the cylinder 55 from the pistons 57, and the pusher sections 57P project outward from the through holes 55H provided on the cover sections 55C. Tips of the pusher sections 57P can touch and separate from a pressing screw 59 as a pressure receiving member provided on the upper portion of the upper die clamp 11.

Further, a resilient member 61 such as a coil spring as a member composing a part of the clamp switching means 15 for biasing the piston 57 to a direction where it is always pressed inward is wound around the pusher sections 57 of the pistons 57. Moreover, an oil passage 63 which communicatively connects with the inside of the cylinder 55 between the two pistons 57 is formed on the block section 7B of the holder body 7, and the oil passage 63 is communicatively connected with a pressure oil supply port 65 provided on a sidewall surface of the block section 7B. The pressure oil supply port 65 is communicatively connected with a pressure oil supply source (not shown) via a hydraulic hose 67.

In a releasing state holding means 19 which freely holds the upper die clamp 11 in a state that the clamp of the upper die 5 is released, as shown in a cross section on the left side of FIG. 5, a spring support 69, which is engaged with a locking hole section 11G formed on the upper portion of the upper die clamp 11 via a resilient member 11S such as a spring, is fixed to the holder body 7, and the upper portion of the upper die clamp 11 is biased to a direction where it is always pressed to the holder body 7 by the resilient member 11S.

The pressure receiving member which constitutes a main section of the mode of the present invention is detailed below.

Figure 7:
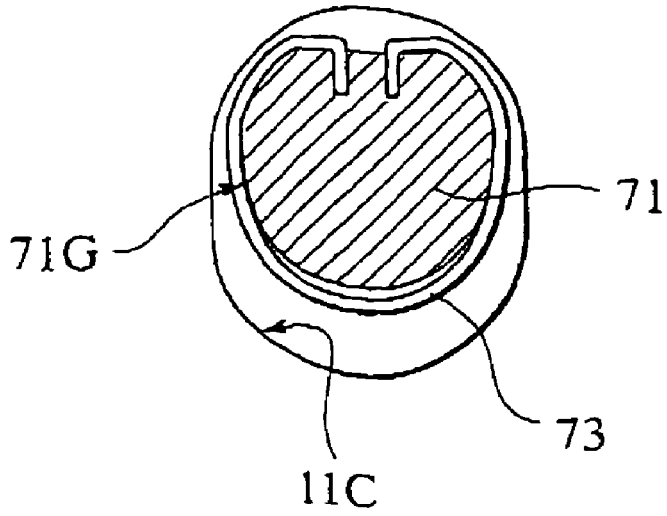
FIG. 7 is a sectional view taken in the direction of the arrow along the line VII—VII in FIG. 3.

With reference to FIG. 3, an elliptical notched portion 11C which is long in the vertical direction (see FIGS. 6 and 7) is provided on a left surface in FIG. 3 on the upper portion of the upper die clamp 11, for example, and a tapped hole 11N which pierces the notched portion 11C is provided. The pressing screw 59 as the pressure receiving member is screwed into the tapped hole 11N so as to freely advance and retreat, and a tip on the left side in FIG. 3 of the pressing screw 59 has a pressure sensing surface 59P which is pressed by the pusher section 57L of the piston 57.

A position lever shaft section 71 is screwed up to an end surface on the left side in FIG. 3 of the pressing screw 59 by a mounting bolt 71B, and the position lever shaft section 71 can be rotated in the notched portion 11C in a state that its outer peripheral surface is approximately screwed into an upper semicircular side wall surface of the notched portion 11C. Moreover, a groove section 71G for a ring is provided along the outer peripheral surface of the position lever shaft section 71, and a stopper ring 73 for restraining rotation of the position lever shaft section 71 to 180° is fitted into the groove section 71G for ring. The stopper ring 73 has a shape such that its lower side in FIG. 7 expands outward from the groove section 71G for ring. When the position lever shaft section 71 rotates by 180°, the expanded portion of the stopper ring 73 touches the upper side wall surface of the notched portion 11C so that the rotation is restrained.

A notched portion 71C for mounting a lever is provided on the lower side in FIGS. 3 and 6 of the position lever shaft section 71, and a position lever 75 which has a shape fitted into the notched portion 71C is screwed up to the position lever shaft section 71. Moreover, a magnet 75M is buried in a right surface in FIG. 3 of the position lever 75, and a spring pin 71P made of iron, for example, as a magnetic material which is attracted to the magnet 75M is buried in an area from the position lever shaft section 71 to the pressing screw 59.

Figure 4:
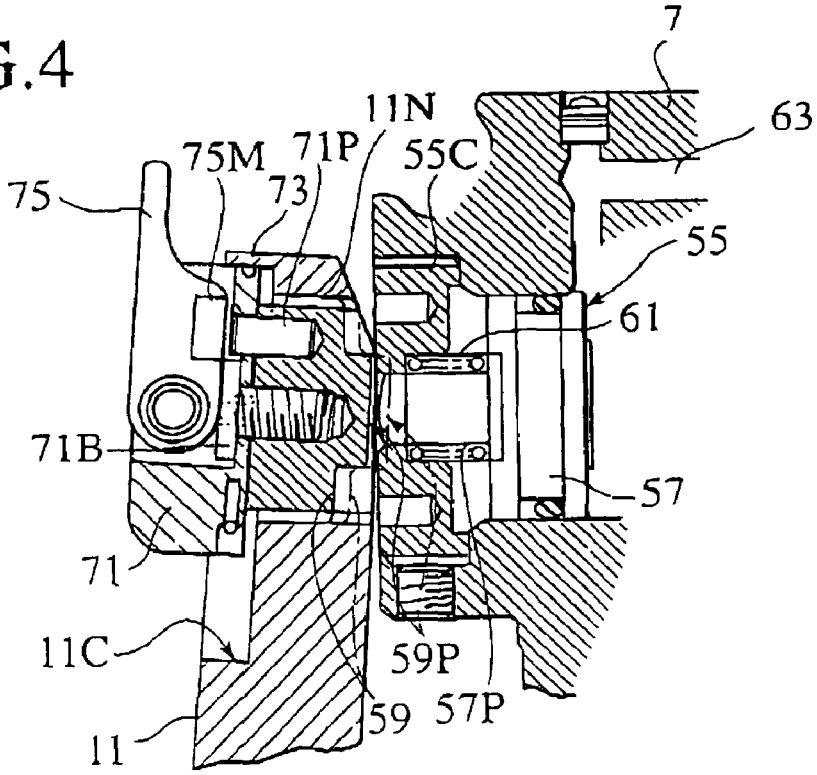
FIG. 4 is a partially sectional view of the mode of the present invention illustrating a second-stage switching state by means of the position lever when the upper die clamp is in the unclamped state.

With the above constitution, in the state of FIG. 3, when the magnet 75M is separated from the spring pin 71P and the position lever 75 is lifted up so as to be rotated by 180°, also the position lever shaft section 71 is rotated by 180°, thereby rotating also the pressing screw 59. As a result, as shown in FIG. 4, the pressure sensing surface 59P of the pressing screw 59 moves from a position represented by an alternate long and short dash line to a position represented by a solid line. According to the rotation of the position lever shaft section 71, the expanded portion of the stopper ring 73 touches the upper sidewall surface of the notched portion 11C so that the rotation by 180° is restrained. When the position lever 75 is returned to its original position, the position lever 75 is attracted to the spring pin 71P via the magnet 75M so as to be fixed to the position lever shaft section 71.

As mentioned above, selection is freely made from a first stage where the pressure sensing surface 59P of the pressing screw 59 is advanced towards the pusher section 57P as shown in FIG. 3 and a second state where the pressure sensing surface 59P is retreated from the side of the pusher section 57 as shown in FIG. 4 by rotating the position lever 75 by 180°. That is to say, an opening quantity of the upper die clamp 11 at the time of unclamping can be freely selected from the two stages.

In the above constitution, as the upper die 5 is shown by an imaginary line in FIG. 5, when pressure oil is supplied into the cylinder 55 in the clamping force applying means 13 in a state that the upper die 5 is clamped between the upper die supporting section 9 of the holder body 7 and the upper die clamp 11, the pistons 57 advance outward against the biasing force of the resilient member 61 and the tips of the pusher sections 57P touch the pressing screw 59 of the upper die clamp 11, so that a pressing force (clamping force) of the cylinder 55 is transmitted thereto.

The upper die clamp 11 on the left side in FIG. 5 is moved rotationally to a counterclockwise direction and the upper die clamp 11 on the right side in FIG. 5 is moved rotationally to a clockwise direction by the pressing force (clamping force) of the cylinder 55, and the upper die clamp 11 presses and fixes the upper die 5 more strongly.

On the contrary, when the pressure oil in the cylinder 55 is discharged, the pistons 57 retreat inward due to the biasing force of the resilient member 61, and the tips of the pusher sections 57P move so as to separate from the pressing screw 59 of the upper die clamp 11 so that pressing force (clamping force) of the cylinder 55 is released.

As shown in the cross section on the left side in FIG. 5, therefore, the upper portion of the upper die clamp 11 is moved to the holder body 7 by the resilient member 11S of the spring support 69, so that the pressing screw 59 on the upper portion of the upper die clamp 11 lightly touches the pusher sections 57P of the clamping force applying means 13, so that the pressing and fixing of the upper die 5 by the upper die clamp 11 are released. The upper die 5 is supported so as to be movable to a longitudinal direction (horizontal direction) in a state that the locking projection 11P of the upper die clamp 11 is engaged with the drop-proof groove 5G.

In such a manner, since the upper die clamp 11 is easily operated by the cylinder 55 (liquid pressure device), the upper die 5 is attached to and detached from the holder body 7 efficiently.

That is to say, the lower portion of the upper die clamp 11 is opened so as to separate from the upper die supporting section 9, so that the upper die 5 can be detached from the upper die clamp 11 so as to be replaced.

More specifically, at the first stage in FIG. 3, the opening quantity of the upper die clamp 11 at the time of unclamping becomes smaller than that at the second stage in FIG. 4 because the position of the pressure sensing surface 59P of the pressing screw 59 advances. The engaged state between the wedge piece 51 and the drop-proof groove 5G of the upper die 5 at this time is such that even if the upper die 5 is tried to be drawn downward against the biasing force of the resilient member 53 to the direction of the upper die supporting section 9 of the wedge piece 51, the tip of the wedge piece 51 projects further than the engaging projection 112 at the lower end of the upper die clamp 11, thereby preventing the upper die 5 from being drawn. So to speak, the upper die 5 cannot be front-fed and front-removed. The upper die 5 can be, however, drawn to the lateral direction.

Further, when the position lever 75 is rotated by 180° so as to be at the second state in FIG. 4, the position of the pressure sensing surface 59P of the pressing screw 59 retreats, so that the opening quantity of the upper die clamp 11 at the time of unclamping is larger than that at the first stage in FIG. 3. The engaged state of the wedge piece 51 with the drop-proof groove 5G at this time is such that the upper die 5 can be drawn downward against the biasing force of the resilient member 53 towards the upper die supporting section 9 of the wedge piece 51. That is to say, the tip of the wedge piece 51 retreats further than the locking projection 11P at the lower end of the upper die clamp 11, so that the upper die 5 can be drawn downward. Moreover, on the contrary, the upper section 5U of the upper die 5 can be inserted between the upper die supporting section 9 of the holder body 7 and the upper die clamp 11 from a lower direction. So to speak, the upper die 5 can be front-fed and front-removed.

According to the above constitution, even if the upper die 5 is slid mightily and thus a stronger force than the biasing force of the resilient member 53 of the wedge piece 51 is applied to the upper die 5 at the time of replacing, the position levers 75 can be switched into the first stage, so that a danger such that the upper die 5 drops even not at the time of first-feeding and first-removal is eliminated completely. Moreover, the position lever 75 is switched into the second stage, so that the upper die 5 can be easily front-fed and front-removed.

By the way, in this mode, since a stroke of the cylinder 55 is about 3 mm, a mechanism having two-stage stroke can not be incorporated into the cylinder 55, and there is generally a limit in incorporating of the cylinder 55 with large stroke due to a thickness of the holder body 7. Moreover, since the 6 to 30 upper die holder apparatuses 1 are attached to the press brake, the clamping force of the cylinder 55 differs according to individual difference between the upper die holder apparatuses 1, and thus an accurate operation cannot desired.

In this mode, however, the two-stage unclamping operation can be performed securely only by a simple operation for rotating the position lever 75 by 180°. Since the press brake has a plurality of the upper die holder apparatuses 1, the simplicity of the switching operation is greatly effective from a viewpoint of operability.

The present invention is not limited to the examples of the mode, and another modes can be carried out by making suitable modifications.

The invention claimed is:

1. An upper die holder apparatus, comprising:

a holder body;

an upper die clamp supported to the holder body with a supporting point supporting said upper die clamp in a vicinity of a center in a vertical direction of the holder body;

a clamping force applier provided to the holder body and pressing an upper portion of the upper die clamp so that the upper die clamp clamps the upper die; and a pressure receiver provided to an upper portion of the upper die clamp and having a pressure sensing surface to be pressed by the clamping force applier, wherein the pressure receiver is provided so that its advancing and retreating are adjusted to a pressing direction by the clamping force applier; and wherein the pressure receiver is provided so that an opening amount of the upper die clamp at the time of unclamping is freely selected between a plurality of stages.

2. The upper die holder apparatus according to claim 1, further comprising:

an upper die support provided to a lower portion of the holder body and supporting an upper die;

a presser provided to a lower portion of the upper die clamp and pressing the upper die against the upper die support; and a lock member provided to a lower portion of the upper die clamp and being biased towards the upper die support so as to freely lock into a drop-proof groove provided to the upper die.

3. The upper die holder apparatus according to claim 2, wherein the opening amount of the upper die clamp at a time of unclamping is adjustable so that a locked state between the locking member and the drop-proof groove of the upper die is freely selected from a first stage where the upper die cannot be drawn downward and a second stage where the upper die can be drawn downward.

4. The upper die holder apparatus according to claim 3, wherein the pressure receiver is screwed into the upper portion of the upper die clamp; and wherein a position lever which is rotated so as to advance and retreat the pressure receiver is provided gradationally to the pressure receiver.

* * * * *